United States Patent [19]

Sheesley

[11] 4,033,616

[45] July 5, 1977

[54] AUTOMOTIVE VEHICLE DOOR RETARDING AND CLOSING MECHANISM

[75] Inventor: Jay R. Sheesley, Glencoe, Ill.

[73] Assignee: Keystone Industries, Inc., Rolling Meadows, Ill.

[22] Filed: June 1, 1976

[21] Appl. No.: 691,600

Related U.S. Application Data

[62] Division of Ser. No. 284,230, Aug. 28, 1972, Pat. No. 3,989,287.

[52] U.S. Cl. ..... 292/216

[51] Int. Cl.[2] ..... E05C 3/26

[58] Field of Search ..... 292/242, 223, 227, 216, 292/280, DIG. 49, 122, 201, 333, 336, 336.3; 70/240, 241, 263, 264; 16/82, 84

[56] References Cited

UNITED STATES PATENTS

| | | | |
|---|---|---|---|
| 2,943,880 | 7/1960 | Joachim et al. | 292/201 |
| 3,173,715 | 3/1965 | Roethel | 292/223 X |
| 3,328,062 | 6/1967 | Geiger et al. | 292/242 X |
| 3,572,066 | 3/1971 | Peters | 292/201 |
| 3,596,484 | 8/1971 | Peters | 70/240 |

*Primary Examiner*—Richard E. Moore

*Attorney, Agent, or Firm*—Hibben, Noyes & Bicknell, Ltd.

[57] ABSTRACT

Mechanism for retarding the speed of closure of the door of an automotive vehicle to prevent slamming and also to effect complete closure of the door after the same has been slowed. A hydraulic piston and cylinder cushioning device is utilized to slow the closure speed of the door to a predetermined low rate and a solenoid-actuated door closing device is utilized to effect a complete closing of the door after slowing by the cushioning device. The cushioning device may be mounted in the door of the vehicle and includes a plunger engageable with the door frame or body of the vehicle to decelerate the door during the last portion of movement thereof toward a closed position. The door closing device may also be mounted in the door of the vehicle and has a latch which coacts with a striker on the body of the vehicle to effect complete closure of the door. The solenoid of the closing device is connected to the battery of the vehicle through an electrical circuit and is effective when energized to effect movement of a lever, which engages and moves the latch to close the door. Electrical switches are provided in the circuit and arranged so that the solenoid is energized when the door reaches a partially closed position and deenergized when the door is completely closed. The door may be opened at any time by manipulation of the usual inside door handle or outside push button.

6 Claims, 16 Drawing Figures

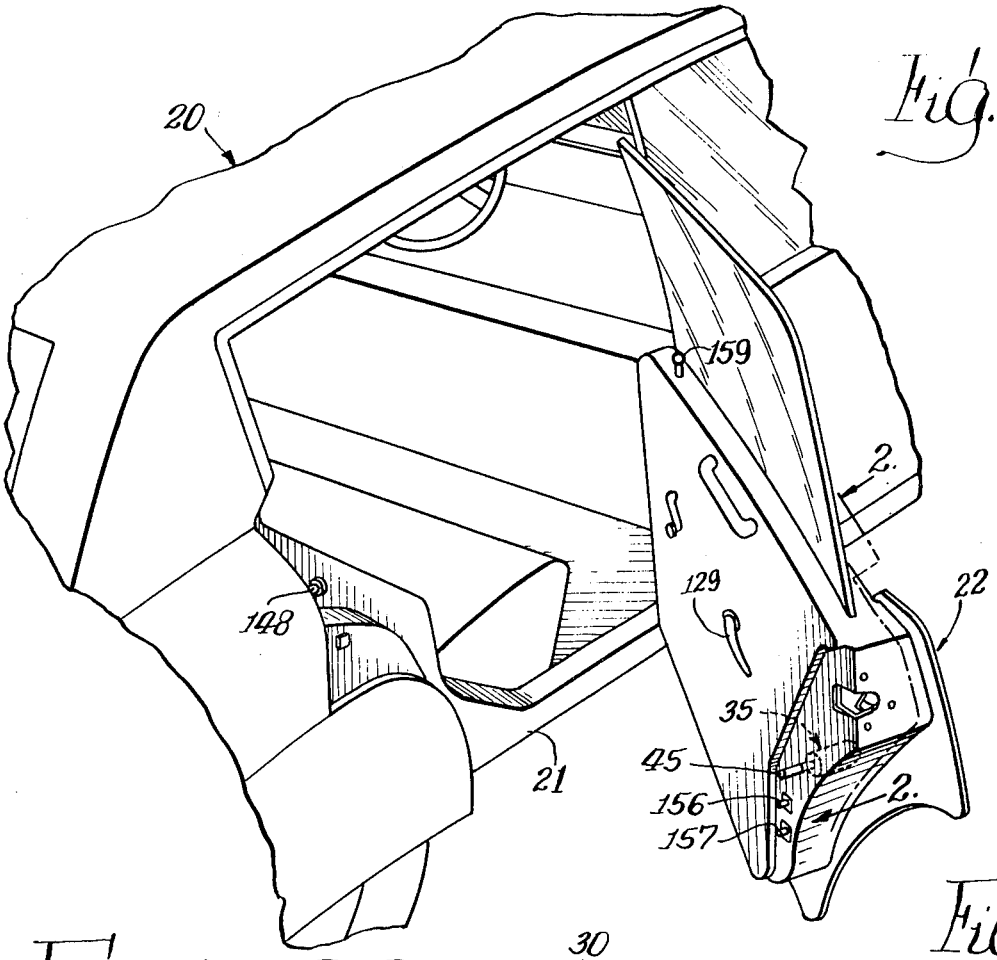
Fig. 1.
Fig. 2.
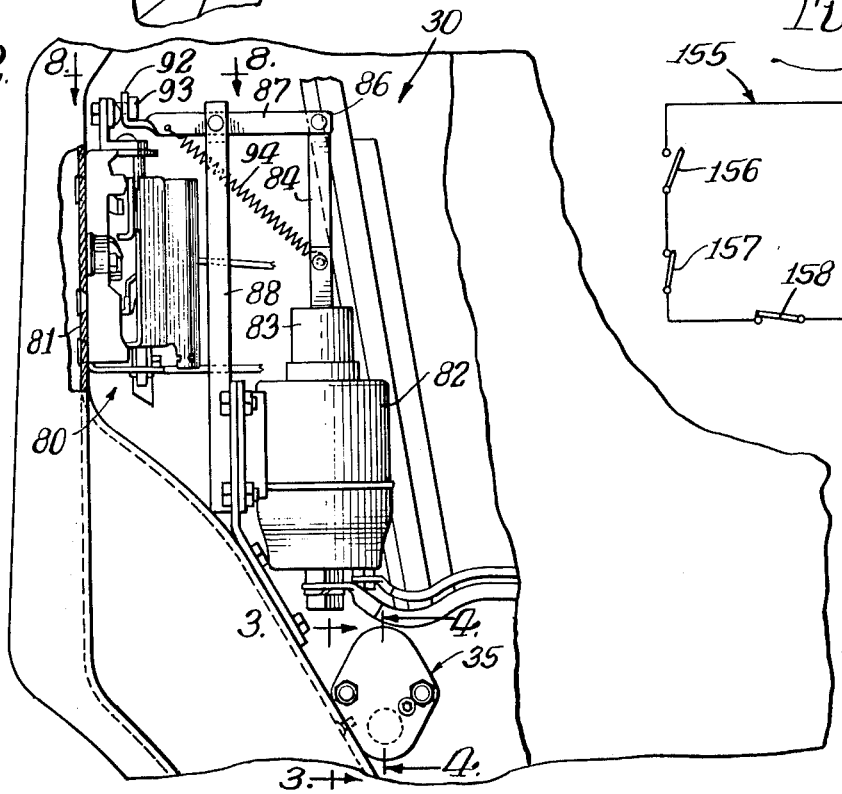
Fig. 13.
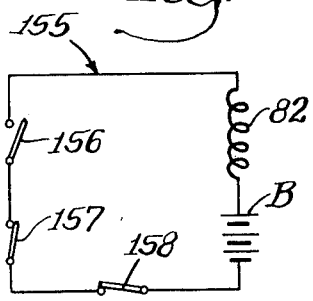

AUTOMOTIVE VEHICLE DOOR RETARDING AND CLOSING MECHANISM

This is a division of application Ser. No. 284,230, filed Aug. 28, 1972, now U.S. Pat. No. 3,989,287, issued Nov. 2, 1976.

This invention relates to a door retarding and closing mechanism, and more particularly to a mechanism for preventing slamming of the door of an automotive vehicle and for effecting complete closure of the door after the same has been slowed.

Many types of door retarding or checking devices have been heretofore advanced for retarding or slowing the movement of a door as it moves toward a closed position. Examples of two of these are disclosed in the Rosenthal et al U.S. Pat. No. 1,704,217 and Armistead U.S. Pat. No. 1,834,671 patents.

Various devices have also been developed for effecting complete closure of a door when the latter has been moved to a partially closed position. An example of one such device is disclosed in the Van Noord U.S. Pat. No. 2,898,138. The Van Noord mechanism, however, employs an electric motor operating through a reduction gear train to effect complete closure of the door of an associated device, such as the door of a household refrigerator. The Van Noord mechanism is, therefore, quite costly.

Safety door locking systems have also been developed for automotive vehicles to prevent injury to the passengers of the vehicle either from an unintentional opening of the doors when the vehicle is in motion, or as a result of a collision, and to prevent intruders from opening the doors of the vehicle while the latter is momentarily stopped. Examples of such systems are disclosed in the Deibel et al. U.S. Pat. No. 3,466,905 and Gowans U.S. Pat. No. 3,531,957. However, the door locking systems disclosed in the aforementioned patents do not employ any type of device for retarding or slowing the speed of closure of the doors before the system is rendered operative, and they are too costly.

Accordingly, it is a general object of the invention to provide a novel mechanism for retarding the speed of closure of the door of an automotive vehicle to prevent slamming and to effect complete closure of the door.

Another object is to provide a novel automotive door retarding and closing mechanism of the foregoing character, which reduces the risk of injury to the fingers of passengers or bystanders during closure of the door of the vehicle.

Still another object is to provide a novel mechanism for retarding and closing the door of an automotive vehicle or the like, wherein an hydraulic piston and cylinder type device is employed to slow the door to a predetermined velocity and wherein a solenoid-actuated device is employed for effecting complete closure of the door after the same has been slowed and moved to a predetermined, partially closed position A further object is to provide a novel automotive vehicle door retarding and closing mechanism of the foregoing character, wherein the solenoid-actuated device for effecting complete closure of the door is automatically energized when the door reaches the partially closed position.

Still another object is to provide a novel automotive vehicle door retarding and closing mechanism which is simple in construction, reliable in operation, and economical to manufacture and maintain.

Other objects and advantages of the invention will become apparent from the following detailed description and accompanying sheets of drawings, wherein:

FIG. 1 is a fragmentary perspective view of an automotive vehicle body incorporating mechanism for retarding and effecting complete closure of the doors thereof, such mechanisms embodying the features of the present invention;

FIG. 2 is a sectional view through the door of the vehicle illustrated in FIG. 1 and taken substantially along the line 2—3 thereof;

Figures 3, 4, 5, 6, 7:
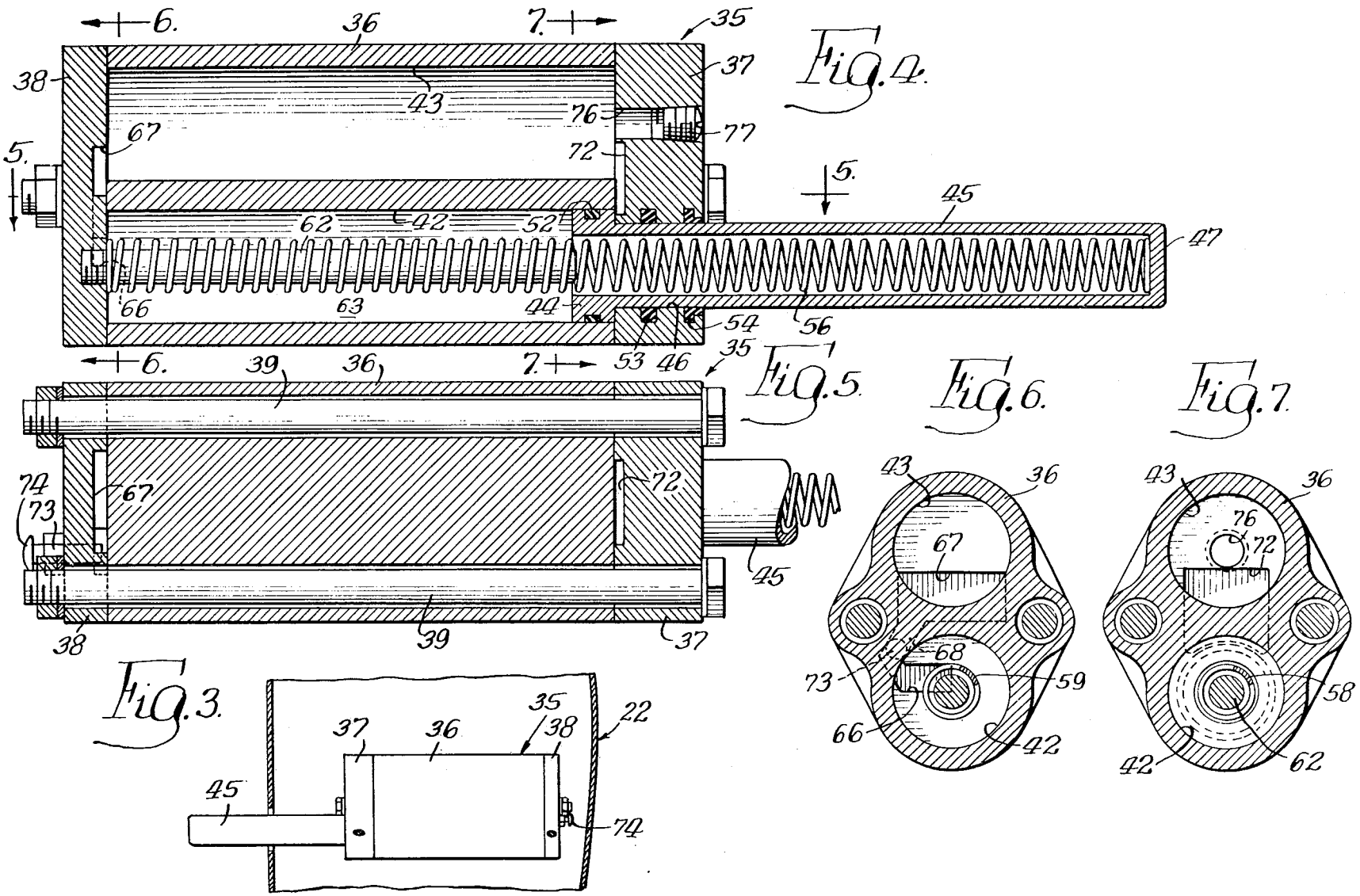
FIG. 3 is a fragmentary sectional view taken along the line 3—3 of FIG. 2 and showing additional details of the retarding device of one of the mechanisms.
FIG. 4 is an enlarged longitudinal sectional view, taken along the line 4—4 of FIG. 2.
FIG. 5 is a horizontal sectional view taken along the line 5—5 of FIG. 4.
Figure 8:
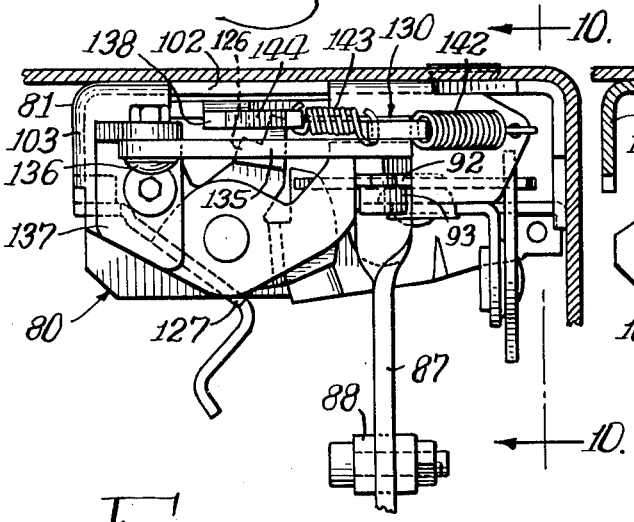
Figure 11:
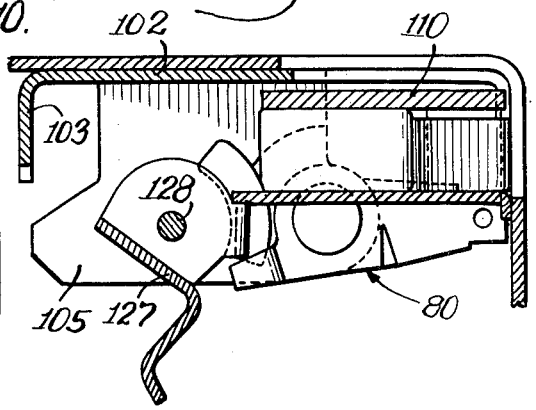
Figure 9:
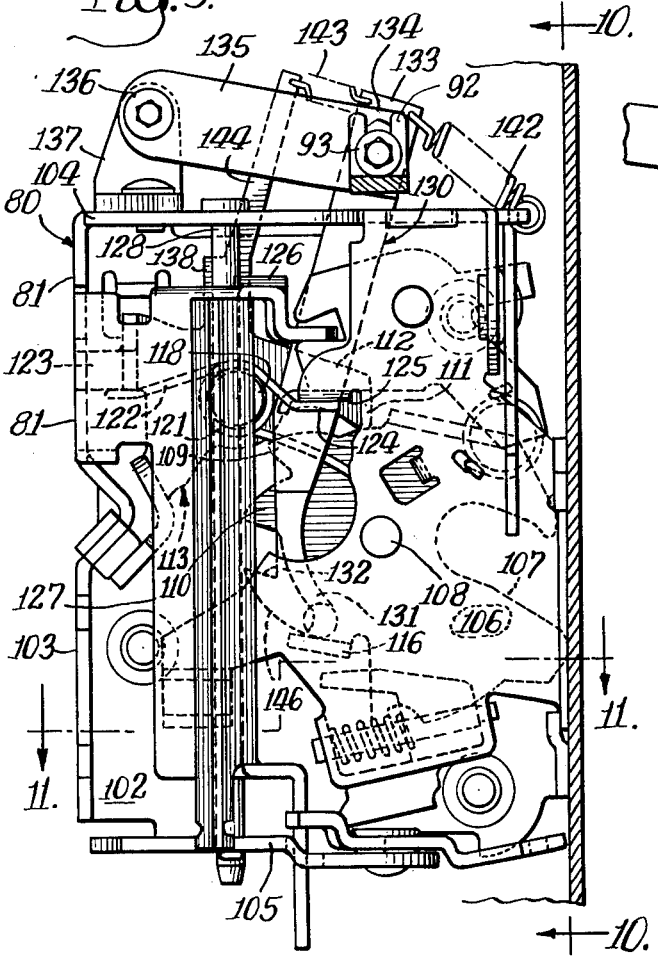
Figure 10:
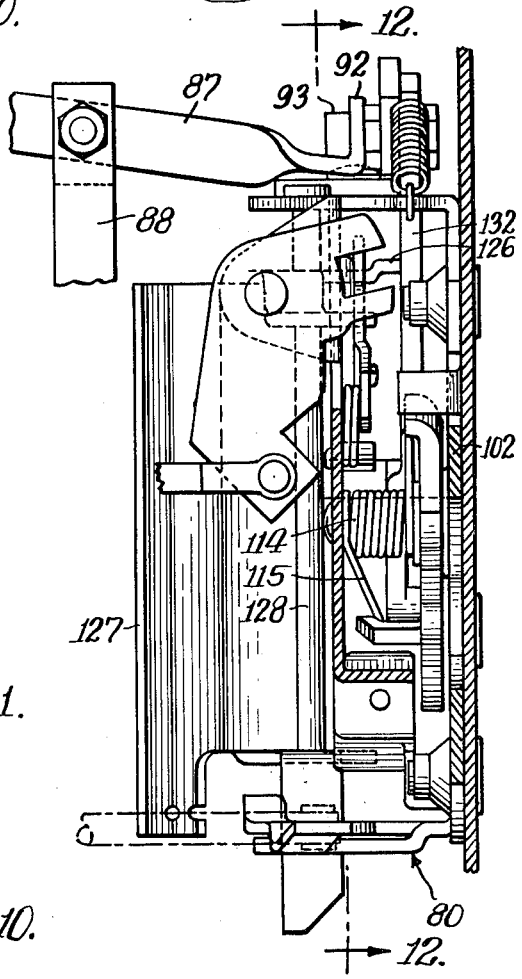
Figure 12:
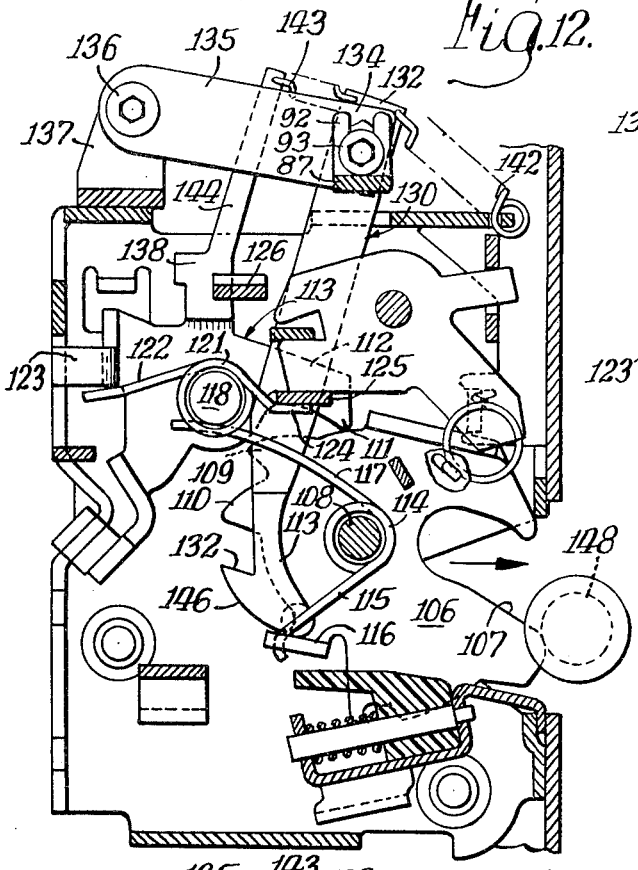
Figure 16:
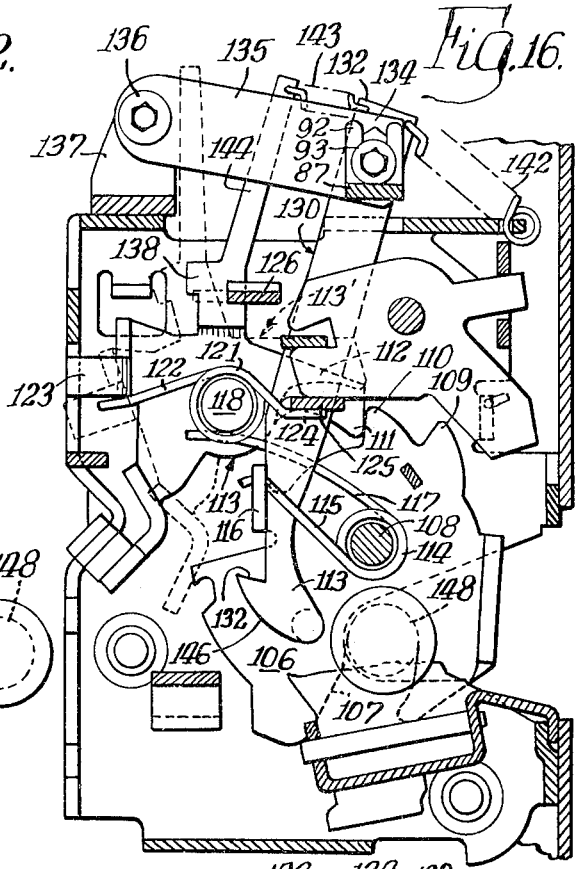
Figure 14:
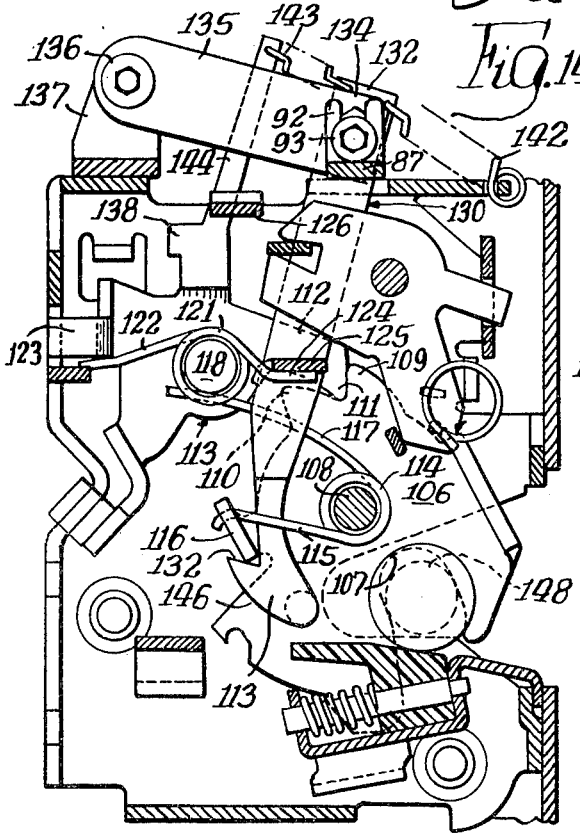
Figure 15:
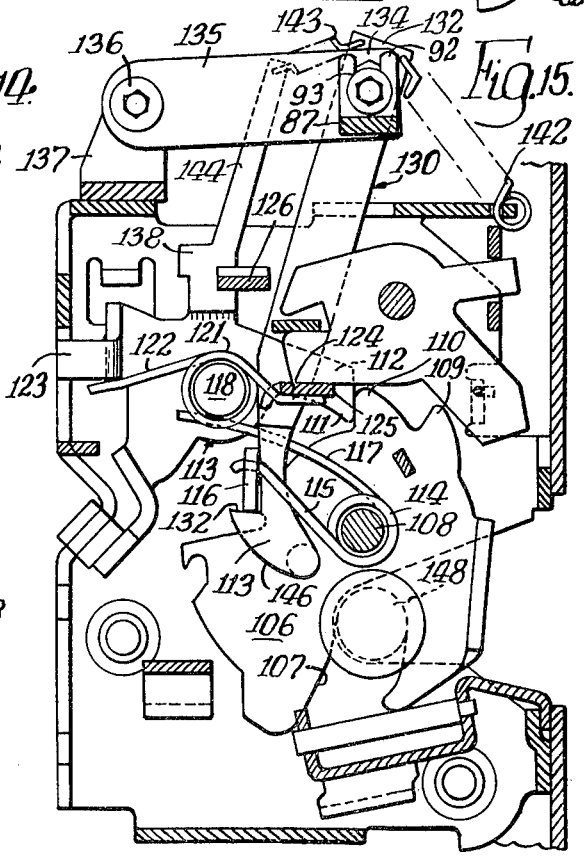

FIG. 6 and 7 are vertical sectional views taken along the lines 6—6 and 7—7 of FIG. 4;

FIG. 8 is an enlarged, top view, taken along the line 8—8 of FIG. 2 and rotated 90° for clarity of presentation, of a portion of the closing mechanism shown in FIG. 2;

FIG. 9 is a front elevational view of the portion of the closing mechanism shown in FIG. 8;

FIG. 10 is a vertical sectional view taken substantially along the line 10—10 of FIG. 8;

FIG. 11 is a horizontal sectional view taken substantially along the line 11—11 of FIG. 9;

FIG. 12 is a vertical sectional view taken substantially along the line 12—12 of FIG. 10;

FIG. 13 is a schematic view of the electrial circuit employed in the door retarding and closing mechanism of the invention; and FIGS. 14–16, inclusive, are a series of sectional views similar to FIG. 12 but showing the parts of the closing device in the positions they would occupy during different portions of the operating cycle of the mechanism.

In FIG. 1 a portion of an automotive vehicle, in the present instance a four door sedan, is illustrated and indicated generally at 20. The vehicle 20 includes a body 21 having a plurality of doors, the right rear door thereof being indicated generally at 22 and shown in an open position.

According to the present invention, each of the doors of the vehicle 20 includes a novel mechanism, indicated generally at 30 in FIG. 2, for retarding the speed of closure of the door to prevent slamming thereof and possible injury to the fingers of a passenger or bystander, and also the effect complete closure of the door after the same has been retarded. It will be understood that mechanisms either identical to the mechanism 30, or modified somewhat in accordance with the structural differences between the doors, are incorporated into the other doors of the vehicle.

Referring now to FIG. 2 in conjunction with FIG. 1 the mechanism 30 generally comprises retarding means in the form of an hydraulic cushioning device 35 for decelerating the door 22 to a predetermined low velocity to prevent slamming thereof, and closure means in the form of a door closing device, indicated generally at 80 in FIG. 2, for moving the door 22 to a fully closed position. The device 80 also functions as a conventional door lock after the mechanism 30 has completed its operating cycle. Since the cushioning device 35 comes into play before the door closing device 80, the construction and operation of the device 35 will be described first.

Referring now to FIGS. 3–7, inclusive, it will be seen that the cushioning device 35 comprises a housing 36 having a pair of end plates or heads 37 and 38 secured to the opposite ends thereof by through-bolts 39. A pair of axially extending circular bores 42 and 43 are provided in the housing 36, and a piston 44 is slidably mounted in the bore 42 for movement between the end heads 37 and 38. The piston 44 includes an integral elongated tubular stem 45, which extends through an opening or bore 46 in the end head 37 and which serves as the actuating plunger of the device 35. The stem 45 is of sufficient length so that the piston 44 will have a total stroke substantially equal to the length of the bore 42. A seal 52 (FIG. 4) is provided in the outer circumferential surface of the piston 44, and at least one and preferably a pair of seals 53 and 54 are provided in the wall of the bore 46 to prevent leakage of hydraulic fluid from the housing at this point.

The piston 44 and its stem 45 are biased to the position thereof shown in FIGS. 3 and 4 by a spring 56, one end of which engages on the inner surface of the end wall, indicated at 47, of the stem 45 and the other end of which engages the inner surface of the end head 38. A guide in the form of a rod 62 is threaded into the end head 38 and serves to support the portion of the spring 56 that extends through the bore 42 in the housing 36. The rod 62 is coaxial with the tubular stem 45 and is received within the latter when the piston 44 is moved toward the end head 38.

The interior of the bore 42 between the piston 44 and the end head 38 comprises a cylinder 63 for receiving a quantity of hydraulic fluid, such fluid being displaced by the piston 44 at a controlled rate as the piston moves toward the end head 38 when the device 35 is in operation. To this end, a pair of generally rectangularly-shaped (FIG. 6) recesses 66 and 67 are provided in the inner surface of the end head 38 and are arranged so as to respectively communicate with the bores 42 and 43. Thus, the recesses 66 and 67, and their connecting groove 68, provide a path for the flow of fluid from the cylinder 63 into the bore 43 when the piston 44 is moving toward the end head 38 on its operating stroke.

In order to provide a path for the return flow of hydraulic fluid from the bore 43 to the portion of the cylinder bore 42 on the opposite side of the piston 44 from the chamber 63, a generally rectangular recess 72 (FIGS. 4, 5 and 7) is provided in the inner surface of the end head 38 and arranged so as to provide communication between the bore 43 and the aforementioned portion of the bore 42 at the rear side of the piston 44. The recess 72 thus completes the return path for hydraulic fluid displaced into the bore 43 by movement of the piston 44 toward the end head 38.

The rate at which hydraulic fluid is displaced from the cylinder 63 into the bore 43, and hence the retarding action provided by the device 35, may be varied by threading the shank, indicated at 73, of a screw 74, into or out of its bore which intersects the groove 68 (FIG. 6) and thus controls the effective cross-sectional area of the passage between the cylinder 63 and bore 43. A bore 76 may be provided in the end head 37 to facilitate the addition of hydraulic fluid to the cushioning device 35, the bore 76 being closed by a removable plug 77 threaded into the outer end thereof.

From the foregoing, it will be apparent that when the cushioning device 35 is operably mounted in the door 22 of the vehicle 20, the stem 45 thereof will be positioned so as to engage some portion of the doorframe or body 21 of the automobile as the door 22 moves toward a closed position. In addition, the screw 74 will be adjusted so that the door 22 will be slowed sufficiently so that a passenger or bystander will be able to withdraw his fingers from the doorframe before the door completely closes. Since the device 35 is effective to slow the door 22 to a predetermined low velocity prior to complete closure, the noise incident to slamming of the door is also eliminated.

After the door 22 has closed and the stem 45 of the device 35 has telescoped into the housing 36 on its working stroke, the return spring 56 in the stem 45 will be compressed in readiness to shift the piston 44 and its stem 45 toward the position thereof shown in FIG. 4 for another cycle of operation. Thus, when the door 22 is again opened, the stem 45 will extend and hydraulic fluid will be displaced by the piston 44 in an opposite direction through the recess 72 to the chamber 43 and thence through the recess 67, groove 68 and recess 66 to the cylinder 63.

Referring again to FIG. 2 in conjunction with FIGS. 8–12, inclusive, it will be seen that the door closing device 80, in the present instance, is also mounted in the door 22 of the vehicle, and includes actuating means in the form of a solenoid 82. To this end, the solenoid 82 is mounted in some convenient location in the door 22 and has its armature 83 connected to the closing device 80 by a link 84 which is connected to one end 86 of a lever 87, the latter being rockably mounted substantially centrally thereof on the upper end of a post 88. The opposite end, indicated at 92, of the lever 87 is bifurcated and engages the shank of a screw 93 threaded into the upper end of an operating lever 130 (not shown in FIG. 2), whose purpose and function will be described more fully hereinafter. A coil spring 94, in the linkage which connects the armature 83 with the operating lever 130 of the closure device 80, assures extension of the armature 83 and movement of the operating lever 130 to an inoperative position when the device 80 has completed its operating cycle.

Referring now to FIGS. 8–12, inclusive, it will be seen, that the device 80 comprises a generally box-like frame 81 having a plate-like base or mounting portion 102, a perpendicularly extending side flange portion 103 and perpendicularly extending top and bottom flange portions 104 and 105, respectively. A latch 106 having a slot 107 therein, is rotatably mounted on a stud 108 carried on the base portion 102 of the frame 81, the latch 106 being movable between a plurality of positions, two of which are determined by a pair of ratchet teeth 109 and 110 thereon. The teeth 109 and 110 are adapted to be sequentially engaged by a finger or tooth 111 carried on an arm 112 of a latching pawl 113. A torsion spring 114 (FIGS. 10 and 12–16, inclusive) is mounted on the stud 108 and has one end 115 engaging a tang 116 on the latch 106 and its opposite end 117 engaging another stud 118 mounted on the base portion 102. The spring 114 biases the latch 106 in a counter-clockwise direction as viewed in FIGS. 9 and 12.

The pawl 113 is also rockably mounted on the stud 118 and is movable between at least two positions, one of which prevents movement of the latch 106 and the other of which permits movement of the latch. The pawl 113 is biased in a clockwise direction, as viewed in FIG. 9 by a torsion spring 121 that is also mounted on the stud 118. One end 122 of the spring 121 engages a tang 123 on the pawl 113 to impart the aforementioned clockwise bias thereto. The opposite end, indicated at 124, of the torsion spring 121 bears against a fixed finger 125 on the frame 81.

Rotation of the pawl 113 in a counter-clockwise direction, as viewed in FIG. 9, to disengage the finger 115 from the ratchet teeth 109 and 110 when the closing device 80 is inoperative, is normally effected by an arm 126 (FIGS. 8, 9, 10 and 12) carried on the upper end of an elongated, angle-shaped lever 127 which is mounted for pivotal movement on a vertically extending shaft 128. The shaft 128 is carried by the frame 81. The arm 126 engages an upstanding arm 138 on the latching pawl 113 and serves to rotate the pawl in a counter-clockwise direction to disengage the end 111 of the finger 115 from the ratchet teeth 109 and 110 when it is desired to unlock the door 22. The lever 127 is connected by linkage (not shown) to an actuating handle 129 (FIG. 1) and button (not shown) on the inside and outside of the door 22, respectively.

According to the present invention, the closing device 80 includes means in the form of the operating lever 130 for effecting positive rotation of the latch 106 in a clockwise direction from its open or striker releasing position illustrated in FIGS. 9 and 12, to its door closing position illustrated in FIGS. 15 and 16. To this end, the lower end, indicated at 131, of the lever 130 is provided with a portion in the form of a hook 132 for engaging the tang 116 and effecting the aforementioned clockwise movement of the latch 106. The upper end, indicated at 133, of the lever 130 is pivotally connected to the free end, indicated at 134 in FIGS. 9 and 12, of a link 135, the opposite end of which is pivotally connected as at 136 to a bracket 137 secured to the top flange 104 of the frame 81. A tension spring 142 is connected to the upper end 133 of the lever 130 and the opposite end of the spring 142 is connected to the top flange 104. A somewhat lighter tension spring 143 is also connected at one end to the upper end 133 of the lever 130 on the opposite side thereof from the spring 142, and the opposite end of the spring 143 is connected to the upper end of an extension 144 welded or otherwise secured to the upper end of the arm 138 on the pawl 113. The purpose of the springs 142 and 143 will be described hereafter in connection with the description of the operation of the closure device 80.

The outer surface, indicated at 146, of the lever 130 at the lower end 131 thereof is curved to permit the tang 116 of the latch 106 to move past the end 131 of the lever when the latch rotates in a clockwise direction upon initial contact thereof with a striker 148 (FIGS. 1 and 12) on the vehicle body 21. Outward or upward movement of the operating lever 130 as viewed in FIG. 9 is achieved by the solenoid 82 (FIG. 2), which is connected to an electrical circuit indicated generally at 155 in FIG. 13.

As best seen in FIG. 13, the electrical circuit 155 includes the battery, indicated at B, of the vehicle 20, a normally open switch 156, and two normally closed switches 157 and 158. The switches 156, 157 and 158 are arranged in series in the circuit 155 and are preferably physically positioned in the door 22. Each of the switches 156 and 157 has a plunger (FIG. 1) for engaging the frame of the door 22 as the latter moves toward its fully closed position, and the switch 158 is connected by linkage (not shown) with the inside handle 129 and outside push button (also not shown) of the door 22. The manner in which the switches 156, 157 and 158 are actuated to effect operation of the closing device 80 will be described hereafter in connection with the description of the operation of the mechanism 30.

Operation of the Door Retarding and Closing Mechanism

Assuming that the door 22 of the vehicle 20 is in open position, as shown in FIG. 2, and either a passenger or bystander has applied a sufficient amount of force to the door to close the same, the mechanism 30 operates as follows to prevent the door from slamming and possibly causing injury to the fingers of the passenger or bystander and also to effect complete closure of the door.

As the door 22 approaches its closed position, the plunger 45 of the cushioning device 35 will contact the door frame or body 21 of the vehicle and begin to offer resistance to movement of the door. Since the device 35 is of the hydraulic type, the amount of resistance offered to continued movement of the door will be in direct proportion to the speed of the door. In other words, if the door is moving at a rapid rate, a large retarding force will be applied thereto by the device 35, and vice versa. However, regardless of its speed of closure, the device 35 will slow the door to some predetermined low rate that is sufficient to prevent slamming and injury to the fingers or hand of a passenger or bystander. In addition, the cushioning device 35 will provide a time interval during deceleration of the door which is normally sufficient to permit a passenger or bystander to withdraw his hand and fingers from the door frame and thereby avoid injury.

After the plunger 45 has completed its working stroke, which may be about two inches, the door 22 will have been slowed to the aforementioned predetermined low rate and the striker 148 will have engaged the latch 106 and rotated the same from a first or striker receiving and releasing position illustrated in FIG. 12, to a second position illustrated in FIG. 14. Such second position corresponds to the usual first or safety latch position of the door 22, wherein the door is only partially closed. At this time, the end 111 of the arm 112 of the latching pawl 113 will engage the ratchet tooth 109 of the latch 106. In addition, the plunger of the normally open switch 156 will cause this switch to close. Consequently, current will flow through the circuit 155 (FIG. 13) and thus through the windings of the solenoid 82 to energize the latter. When energized, the armature 83 of the solenoid is drawn in and the lever 87 will be caused to rock in a clockwise direction as viewed in FIG. 2. The operating lever 130 will thus be extended to the position shown in FIG. 15. During movement of the lever 130 to its extended position, the hook 132 thereof will engage the tang 116 of the latch 106 and effect positive clockwise rotation thereof (as viewed in FIGS. 9, 12 and 14–16, inclusive) to a third position illustrated in FIGS. 15 and 16. Such third position corresponds to the completely closed position of the door 22. The cam action of the slot 107 on the striker 148 effects complete closure of the door 22 so the latch 106 moves from its second (FIG. 14) to its third position (FIGS. 15 and 16).

When the door 22 is completely closed, the latch 106 will be in its third position shown in FIG. 15 and the end 111 of the latch arm 112 will be engaged with the second ratchet tooth 110 of the latch 106. At this time, the plunger of the normally closed switch 157 will cause the switch to open. Consequently, the solenoid 82 will be de-energized and the armature 83 thereof will be extended to the position illustrated in FIG. 2 under the influence of the linkage spring 93 and the coil springs 142 and 143, which are secured to the upper end 132 of the lever 130. As the lever 130 moves from its extended FIG. 15 position to its retracted FIG. 16 position, the hook 132 at the lower end of the lever 130 will move out of engagement with the tang 116 on the latch 106. The latch 106 will, however, be retained in its door retaining or locking position illustrated in FIGS. 15 and 16 due to the above-mentioned engaged relation of the end 111 of the latch arm 112 with the ratchet tooth 110.

Assuming that a passenger or bystander wishes to open the door 22 and that the door lock button, indicated at 159 in FIG. 1, is in its release position, he need only manipulate either the inner handle 129 or the outer release button to its usual door unlocking position. Such movement causes the arm 126 of the lever 127 to engage the arm 138 on the latch pawl 113 and pivot the latter in a counter-clockwise direction from the full line position thereof shown in FIGS. 9 and 12–16, inclusive, to the broken line position thereof indicated at 113' in FIG. 16. When so positioned, the latch 106 will pivot in a counter-clockwise direction under the bias of the torsion spring 114 and thereby release the striker 148. The manipulation of either the inner handle 129 or outer release button of the door also causes the normally closed switch 158 (FIG. 13) in the electrical circuit 155 to open. Consequently, the solenoid 82 cannot be energized as the door 22 opens. When the latch 106 reaches the position thereof illustrated in FIG. 12, the mechanism 30 is ready for another cycle of operation.

The mechanism 30 is fail-safe in that if the battery B of the vehicle weakens or becomes dead, the solenoid 82 will be unable to effect movement of the operating lever 130 so that the closing device will be inoperative. The device 80 will then function as an ordinary door locking mechanism.

While the cushioning device 35 and door closing device 80 have been herein described as being mounted in the door 22 of the vehicle 20, it will be understood that either one or both of these structures could be mounted in the body 21 or door frame of the vehicle and that the striker 148 could be mounted on the door 22. It will further be understood that while an electrical solenoid 82 has been herein described as the source of movement of the operating lever 130, some other type of servo device could be used instead, as for example a pneumatic or hydraulic cylinder.

While only one embodiment of the invention has been herein illustrated and described, it will be understood that modifications and variations thereof may be effected without departing from the scope of the invention as exemplified in the appended claims.

I claim:

1. A device for effecting complete closure of the door of an automotive vehicle or the like after the door has moved to a predetermined, partially closed position, comprising a frame adapted to be mounted on one of said vehicle door and body, a latch movably mounted in said frame and having an opening therein for receiving a striker, said striker being adapted to be mounted on the other of said door and body, said latch being operable when in one position to permit said striker to move into or out of said opening and being operable during movement to another position to engage said striker and effect relative movement thereof to a position corresponding to the closed position of said door, first spring means biasing said latch to said one position, a pawl movable between a first position engaging and preventing movement of said latch and a second position spaced from and permitting movement of said latch, said pawl being adapted to be moved to said second position by manually actuated means mounted on the door of said vehicle, and an operating lever movably carried by said frame and having a portion directly engageable with said latch, said operating lever being movable to a first position permitting movement of said latch relative thereto and to a second position causing movement of said latch to its other position, whereby said operating lever is effective when moved from the first to the second position thereof to cause the door of said vehicle to move to a fully closed position.

2. The mechanism of claim 1, further characterized in that said latch has a tang projecting outwardly therefrom, and said portion of said operating lever comprises a hook engageable with said tang and operable to effect rotation of said latch as said lever moves from said first position toward said second position.

3. The mechanism of claim 2, further characterized in that guide means is provided for guiding movement of said lever relative to said frame during movement of said lever between said first and second positions.

4. The mechanism of claim 3, further characterized in that said guide means comprises a slot in said frame for receiving said lever, and a link having one end pivotally connected to said frame and the opposite end thereof pivotally connected to the end of said lever opposite from the hook end thereof.

5. The mechanism of claim 4, further characterized in that said guide means also includes spring means connected to said opposite end of said lever and operable to bias the hook thereof away from said tang as said lever moves from said second position toward said first position, whereby said hook is clear of the path of movement of said tang as said latch moves from said one position toward the other position thereof.

6. The mechanism of claim 5, further characterized in that said spring means includes a first spring having one end connected to said frame and its opposite end connected to said opposite end of said lever, said spring means also including a second spring having one end connected to said pawl and its opposite end connected to said opposite end of said lever.

* * * * *